US009901842B2

(12) United States Patent
Rõttjer et al.

(10) Patent No.: US 9,901,842 B2
(45) Date of Patent: Feb. 27, 2018

(54) TOY BUILDING SET

(75) Inventors: Christoph Rõttjer, Flensburg (DE); Cerim Manovi, Flensburg (DE); Christoffer Raundahl, Vejle (DK)

(73) Assignee: LEGO A/S (DK)

( * ) Notice: Subject to any disclaimer, the term of this patent is extended or adjusted under 35 U.S.C. 154(b) by 0 days.

(21) Appl. No.: 13/879,793

(22) PCT Filed: Oct. 21, 2011

(86) PCT No.: PCT/EP2011/068421

§ 371 (c)(1),
(2), (4) Date: Aug. 22, 2013

(87) PCT Pub. No.: WO2012/052541

PCT Pub. Date: Apr. 26, 2012

(65) Prior Publication Data

US 2014/0148076 A1 May 29, 2014

(30) Foreign Application Priority Data

Oct. 22, 2010 (DK) ..... 2010 00963

(51) Int. Cl.
*A63H 3/16* (2006.01)
*A63H 33/06* (2006.01)

(52) U.S. Cl.
CPC ..... *A63H 33/06* (2013.01); *A63H 33/062* (2013.01)

(58) Field of Classification Search
CPC ..... A63H 33/06; A63H 33/062; A63H 3/46; A63H 3/16

(Continued)

(56) References Cited

U.S. PATENT DOCUMENTS 1,359,030 A 11/1920 Cabana
1,383,906 A 7/1921 Evans (Continued)

FOREIGN PATENT DOCUMENTS

CN 1208358 A 2/1999
CN 201350334 Y 11/2009

(Continued)

OTHER PUBLICATIONS

Search Report issued from the Danish Patent and Trademark Office, for priority application DK PA 2010 00963, dated Jun. 1, 2010.

(Continued)

*Primary Examiner* — Vishu Mendiratta
(74) *Attorney, Agent, or Firm* — Day Pitney LLP

(57) ABSTRACT

A toy building set comprising at least a first building element having a ball (5,10) arranged on a connecting rod on each element, and a second building element having a socket (6) arranged and adapted for receiving said ball in order to form an articulated ball and socket joint. According to the invention the building set also comprises at least one third building element having a second type of socket (9) being adapted for receiving said ball on the first building element in order to provide a snap connection between the second type of socket and the ball, and where the first building element and the third building element comprises positioning means adapted for engaging with each other when the ball (5) is received in the second type of socket (9), so as to hold the third building element in a fixed position with respect to the first building element.

4 Claims, 3 Drawing Sheets

(58) Field of Classification Search
USPC ..... 446/97, 98, 99, 100, 102
See application file for complete search history.

(56) References Cited

U.S. PATENT DOCUMENTS

| | | | | |
|---|---|---|---|---|
| 1,746,839 | A | 2/1930 | Main et al. | |
| 1,760,260 | A | 5/1930 | Walters | |
| 2,619,640 | A * | 12/1952 | Weissberg | A42B 1/247 2/10 |
| 2,662,335 | A | 12/1953 | Calverley et al. | |
| 2,667,939 | A | 2/1954 | Lincoln | |
| 2,714,269 | A | 8/1955 | Stafford | |
| 2,748,517 | A | 6/1956 | Berkis | |
| 2,752,726 | A | 7/1956 | Calverley | |
| 2,810,576 | A | 10/1957 | Massey | |
| 3,419,993 | A * | 1/1969 | Rodgers | 446/100 |
| 3,428,286 | A * | 2/1969 | Del Pesco | F16M 11/14 248/278.1 |
| 4,193,597 | A | 3/1980 | Ogawa | |
| 4,617,001 | A * | 10/1986 | Parein | 446/102 |
| 4,723,931 | A | 2/1988 | Allen et al. | |
| 5,186,673 | A * | 2/1993 | Fogarty et al. | 446/98 |
| 5,752,869 | A | 5/1998 | Huff | |
| 5,769,681 | A * | 6/1998 | Greenwood, Sr. | A63H 33/101 446/120 |
| 5,897,417 | A * | 4/1999 | Grey | A63H 33/062 403/340 |
| 5,913,706 | A | 6/1999 | Glickman et al. | |
| 6,030,270 | A * | 2/2000 | Krog | 446/102 |
| 6,568,986 | B2 * | 5/2003 | Kobayashi | 446/268 |
| 6,929,527 | B1 | 8/2005 | Chan | |
| 2003/0027488 | A1 | 2/2003 | Langton | |
| 2003/0162477 | A1 * | 8/2003 | Jheow | 446/376 |
| 2004/0018799 | A1 | 1/2004 | Lee | |
| 2004/0212148 | A1 | 10/2004 | Losey et al. | |
| 2006/0189248 | A1 | 8/2006 | O'Brien | |
| 2008/0268741 | A1 * | 10/2008 | Pinsker | A63H 33/062 446/120 |
| 2010/0210171 | A1 * | 8/2010 | Chan | 446/98 |
| 2010/0255753 | A1 * | 10/2010 | Norman et al. | 446/268 |
| 2013/0210314 | A1 | 8/2013 | Rottjer et al. | |
| 2014/0148076 | A1 | 5/2014 | Rottjer et al. | |

FOREIGN PATENT DOCUMENTS

| | | | |
|---|---|---|---|
| DE | 3143496 | A1 | 6/1983 |
| DE | 8701264 | U1 | 7/1987 |
| EP | 0490033 | A1 | 6/1992 |
| EP | 0856341 | A2 | 8/1998 |
| EP | 1068886 | A2 | 1/2001 |
| GB | 177739 | A | 4/1922 |
| GB | 1313277 | A | 4/1973 |
| JP | 58500840 | S | 5/1983 |
| JP | H09173656 | A | 7/1997 |
| JP | H10127953 | A | 5/1998 |
| JP | 2006262944 | A | 10/2006 |
| JP | 3141096 | U | 4/2008 |
| WO | 2008100417 | A2 | 8/2008 |
| WO | 2012052475 | A1 | 4/2012 |

OTHER PUBLICATIONS

International-Type Search Report issued from the International Searching Authority, for priority application DK PA 2010 00963, dated Feb. 17, 2011.
International Search Report for co-pending international application No. PCT/EP2011/068421, dated Nov. 17, 2011.
Office Action in corresponding Chinese Patent application No. 201180061965.6, dated Sep. 19, 2014, 8 pages.
International Search Report for related international application PCT/EP2011/068255, mailed on Feb. 15, 2012.
International-Type Search Report issued from the Danish Patent and Trademark Office for priority application PA 2010 30961, mailed on Jun. 1, 2011.
Notification of Reasons for Refusal issued in related JP patent application No. 2013-534336, translated Oct. 21, 2015. (English translation only).
U.S. Non-Final Office Action issued in related U.S. Appl. No. 13/880,324, dated Oct. 3, 2014.
U.S. Final Office Action issued in related U.S. Appl. No. 13/880,324, dated Jun. 11, 2015.
U.S. Non-Final Office Action issued in related U.S. Appl. No. 13/880,324, dated Dec. 24, 2015.
JPO's Notification of Reasons for Refusal issued in related Japanese patent application No. JP 2013-534307, dated Oct. 14, 2015. (English translation only).
International Search Report issued in related international application No. PCT/EP2011/068332, dated Nov. 9, 2011.
The electric shock, HOBBY Magazine, June item and incorporated company media—works, 8th vol. of No. 8, 91st volume of the set, and 150-151, p. 3, Jun. 1, 2006. (The description of U.S. Pat. No. 4,723,931 A) (English translation unavailable).
USPTO's Non-Final Office Action issued in related U.S. Appl. No. 13/879,787, dated Aug. 28, 2014.

* cited by examiner

TOY BUILDING SET

CROSS-REFERENCE TO RELATED APPLICATIONS

This application is the U.S. National Stage of International Application No. PCT/EP2011/068421, filed on Oct. 21, 2011, and published on Apr. 26, 2012 as WO/2012/052541, which in turn claims the benefit of priority to Danish Patent Application Serial No. PA 2010 00963, filed on Oct. 22, 2010.

The present invention relates to a toy building set comprising at least a first building element having a ball arranged on a connecting rod on each element, and at least one second building element having a socket arranged and adapted for receiving said ball in order to form an articulated ball and socket joint.

DESCRIPTION OF RELATED ART

Toy building sets of the above mentioned type are well known in many different embodiments, and very often they are designed to provide the possibility of building toy figures that represents a person, a robot, an animal, a monster or the like.

Examples of the above kind of building sets are known from e.g. EP patent application no. 856341 disclosing a number of separate building elements that can be connected via ball and socket joints to form an articulated toy figure, or from U.S. Pat. No. 579,681, disclosing many different kinds of elements having coupling balls and complementary sockets that can be connected to each other in many different ways to form articulated figures or constructions.

A problem with this kind of building sets is however that the relative standardised building elements do not themselves look specifically appealing if they are to be used for building toy figures of different kinds, because the design impression of each toy figure, will be almost the same.

Other building sets are therefore known in the art, where the building elements are designed to look more like real body parts.

The problem with these building sets is, however, that each building element is designed specifically in order represent a specific body part, and therefore the use of each building element is limited.

SUMMARY OF THE INVENTION

The main object of the present invention is therefore to provide a toy building set where each building by simple means provides more different uses, and hence making it easy to build a lot of different toy figures from a number of different building elements.

This is obtained according to the present invention defined in claim 1, and especially by having that the building set also comprises at least one third building element having a second type of socket being adapted for receiving said ball on the first building element in order to provide a snap connection between the second type of socket and the ball, and where the first building element and the third building element comprises positioning means adapted for engaging with each other when the ball is received in the second type of socket, so as to hold the third building element in a fixed position with respect to the first building element.

In this way the same ball provides the possibility of mounting different socket for obtaining different functions, and especially in relation to toy figures then first and the second building element could be elements designed for representing bones in a toy figure, and the third building element could be designed for representing muscles, mechanical or electrical actuators or any other shape that gives applies volume to the first and the second building elements forming the bone structure of the figure.

In a preferred embodiment precisely two connection rods extends from the ball at opposite side from the ball.

In this relation it is especially advantageous if the connection rods, at least close to the ball, has a square cross section, and the second type of socket may preferably comprise two resilient flanges that extends from a surface on the third building element, so that the two resilient flanges each has a surface facing the other resilient flange, and being adapted for snapping the ball in between the resilient flanges.

Fixed positioning of the third building element on the first building element is obtained if the positioning means on the third building element comprises a set of side flanges arranged on at least one of the two resilient flanges, and where the side flanges is adapted to be positioned very close to the square section of each of the connection rods when the ball is snapped in between the two resilient flanges.

The socket on the second building element may preferably comprise two resilient jaws each having a concave surface facing the other jaw, and where the distance between the concave surfaces is so that the ball can be snapped in between them, so that the resilient jaws are both pressing against the ball when the ball is snapped in between the jaws.

In this relation it is advantageous if the socket on the second building element is formed such that it allows that the second building element, apart from the frictional fit between the ball and the two jaws, can rotate freely around the ball, when the ball is snapped in between the two resilient jaws.

In a preferred embodiment the force by which the resilient flanges on the third building element presses against the ball when it is snapped in between them, is zero, or at least significantly lower than the corresponding force by which the two resilient jaws are pressed against the ball when it is snapped in between them.

In a further preferred embodiment the first building element also comprises a second ball being connected to the first building element by a second type of connection rod, and having a significantly smaller cross section close to the second type of ball.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

Figure 1:
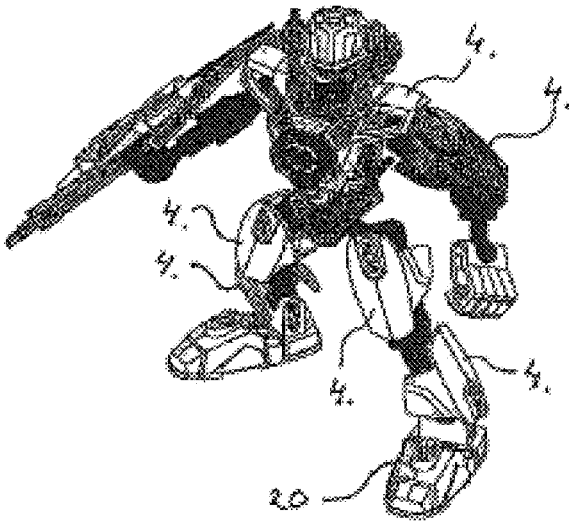
FIG. 1 shows a toy figure according to the invention.
Figure 2:
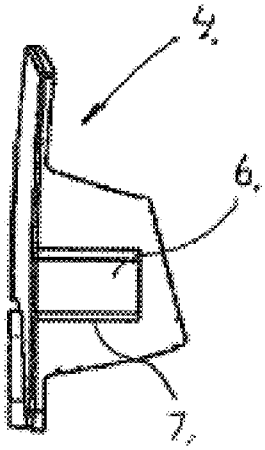
FIG. 2 is a sectional view of one of the design elements according to the invention, and shown on the figure in FIG. 1.

FIG. 1 shows a toy figure built by using the building elements according to the present invention. The bone structure of the figure is made i.a. from the building elements 1, 2 and 3 according to FIGS. 3, 4 and 5, and a number of design elements 4 such as the one shown in FIG. 2 is according to the invention attached to the bone structure of the toy figure.

Figure 4:
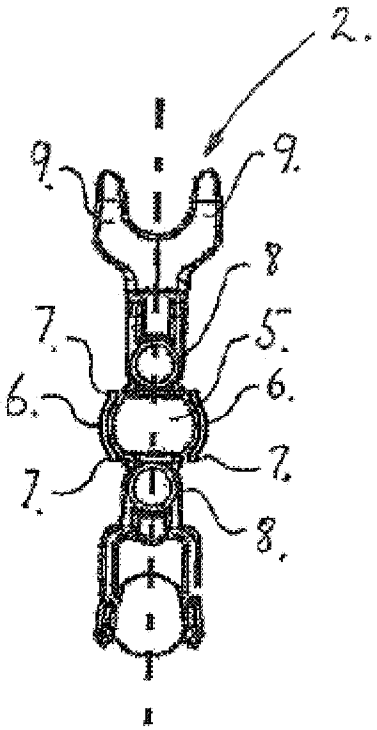
FIGS. 3, 4, and 5 show different embodiments of body elements shown in FIG. 1.
Figure 3:
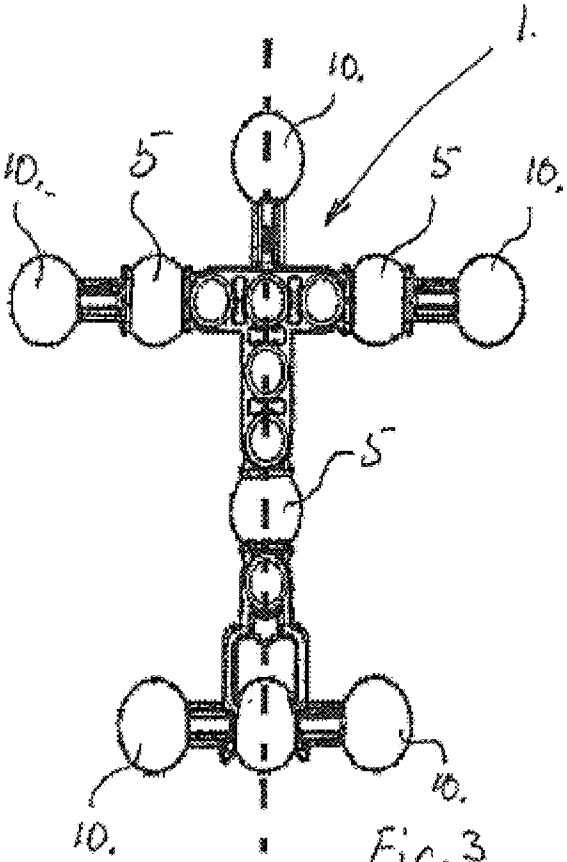
Figure 5:
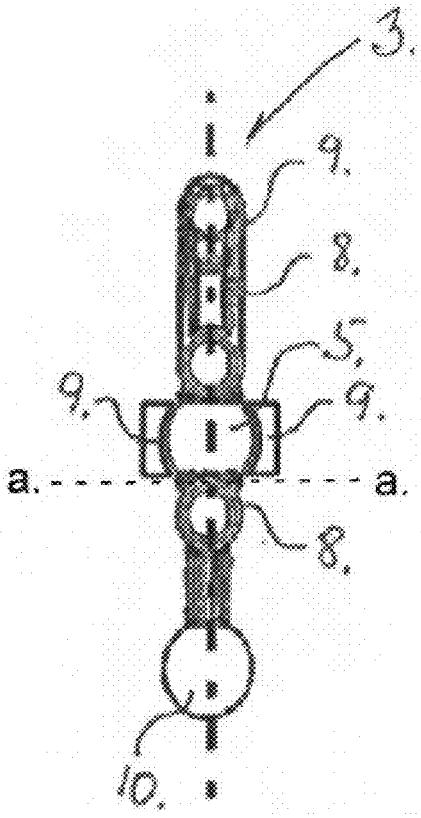
Figure 5A:
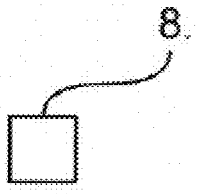
FIG. 5*a* shows the shape of the square cross-section of the rod shown in FIG. 5 along axis a-a.

The design element has two resilient flanges 6 (only one is visible in FIG. 2) arranged on one side of the design element, and these two resilient flanges are placed with a mutual distance, and are formed such that a ball 5 on one of the building elements shown in FIG. 3, 4 or 5 can be snapped in between the two resilient flanges 6 in order to attach the design element on the ball 5 on the building element, such as it is illustrated on FIG. 4, showing that the ball 5 is placed between the two resilient flanges 6.

In this embodiment the resilient flanges 6 has side flanges 7 being in close proximity to a part of the connection rods 8 having a square cross section. Thereby the design element can not rotate around the ball 5 without releasing the snap connection between the ball 5 and the resilient flanges 6. Therefore the resilient flanges do not have to press against the ball 5 in order to keep the design element at a fixed position with respect to the ball 5.

The building elements according to FIGS. 4 and 5 also shows that these building elements have a set of resilient jaws 9 each having a concave surface facing the other jaw, and where the distance between the concave surfaces is so that the ball can be snapped in between them, such as it is illustrated in FIG. 5, showing a ball 5 being placed between the jaws 5 being part of another building element (not shown). In order to ensure that the resilient jaws 9 can not rotate freely around the ball 5, then the jaws are designed so that the concave surfaces on the jaws 9 are both pressed against the ball 5 in order to provide a frictional resistance.

As the resilient jaws 9, however, are only abutting the spherical surface of the ball 5, then it is possible to force the resilient jaws 9 to rotate around the ball 5 in FIG. 5.

According to the present invention it is hereby possible to built a construction, and especially a toy figure by first building a bone structure for the toy figure by using the building elements according to FIGS. 3, 4 and 5, where the building element shown in FIG. 3 will be useful for representing a corpus for the bone structure, and the two elements shown in FIGS. 4 and 5 can be used as bone structure for e.g. the upper arm or forearm of the toy figure shown in FIG. 1 by attaching the resilient jaws 9 to the balls 10 of the corpus.

As the balls 5 and 10 have the same size, then it is possible to mount both building elements and design elements on the same ball 5, 10, and thereby a lot of different possibilities are provided, by simple means, for building a large number of different constructions or figures having very different functions.

It will be evident to the skilled person that it is possible, without departing from the inventive idea according to the claims, to suggest other designs for the building elements and the design elements, than the ones shown in the figures.

The invention claimed is:

1. A toy building set comprising:

at least a first building element having a ball and precisely two connection rods extending from the ball at opposite sides, the connection rods each having a square cross section at least at a portion close to the ball; and a second building element having a socket comprising two resilient jaws each having a concave surface facing the other jaw, and having a distance between the concave surfaces configured such that the ball is adapted to be snapped in between the concave surfaces of the jaws for forming a feely-articulated ball and socket joint;

wherein the building set also comprises at least one third building element having a second type of socket comprising two resilient flanges extending from a surface of the third building element, and wherein the two resilient flanges each has a surface facing the other resilient flange, and having a distance between the opposed resilient flanges configured such that the ball is adapted to be snapped in between the resilient flanges; and wherein at least one of the two resilient flanges comprises a set of side flanges arranged thereon, wherein the side flanges are configured to abut the square cross section of the connecting rod when the ball is snapped in between the two resilient flanges.

2. A toy building set according to claim 1, wherein the distance between the concave surfaces is such that the ball can be snapped in between them, and such that the resilient jaws are both configured to press against the ball when the ball is snapped in between the jaws.

3. A toy building set according to claim 1, wherein the force by which the resilient flanges on the third building element presses against the ball when it is snapped in between them is lower than the corresponding force by which the two resilient jaws on the second building element are pressed against the ball when it is snapped in between them.

4. A toy building set according to claim 1, wherein the first building element further comprises a second ball being connected to the first building element by a second type of connection rod, the second ball having a significantly smaller cross section near the second ball than the cross section of the connecting rods near the ball of the first building element.

* * * * *